US006728291B1

(12) United States Patent
Schubert et al.

(10) Patent No.: US 6,728,291 B1
(45) Date of Patent: Apr. 27, 2004

(54) MELTING VESSELS PROVIDED WITH A COOLED BOTTOM ELECTRODE

(75) Inventors: Manfred Schubert, Oberhausen (DE); Peter Starke, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/980,159

(22) PCT Filed: Jun. 3, 2000

(86) PCT No.: PCT/EP00/05068

§ 371 (c)(1),
(2), (4) Date: Feb. 28, 2002

(87) PCT Pub. No.: WO00/76275

PCT Pub. Date: Dec. 14, 2000

(30) Foreign Application Priority Data

Jun. 4, 1999 (DE) ..... 199 25 554

(51) Int. Cl.[7] ..... F27D 1/00
(52) U.S. Cl. ..... 373/72; 373/52
(58) Field of Search ..... 373/70–72, 88, 373/42, 44, 45, 52, 53; 266/265; 75/10.1

(56) References Cited

U.S. PATENT DOCUMENTS

| | | | | |
|---|---|---|---|---|
| 4,228,314 A | * | 10/1980 | Stenkvist | 373/72 |
| 4,435,812 A | | 3/1984 | Guido et al. | |
| 4,853,941 A | * | 8/1989 | Rappinger et al. | 373/72 |
| 5,371,759 A | * | 12/1994 | Wells et al. | 373/72 |

FOREIGN PATENT DOCUMENTS

| | | |
|---|---|---|
| DE | 4424009 | 1/1996 |
| DE | 195 43 374 A1 | 5/1997 |
| EP | 0422406 | 4/1991 |

* cited by examiner

*Primary Examiner*—Tu Ba Hoang
(74) *Attorney, Agent, or Firm*—Friedrich Kueffner

(57) ABSTRACT

The aim of the invention is to improve the cooling of the bottom electrodes (1) of metallurgical melting vessels. To this end, a cooling plate (5) is situated beneath the support plate (2) on which the contact elements (3) are supported. The cooling plate is set apart from the support plate. This forms a cooling chamber (4) through which a cooling medium flows, the cooling effect of said medium being reinforced by cooling ribs (6). Said cooling ribs are situated in the cooling chamber (4) and are welded to the support plate (2) and preferably, also to the cooling plate (5).

5 Claims, 1 Drawing Sheet

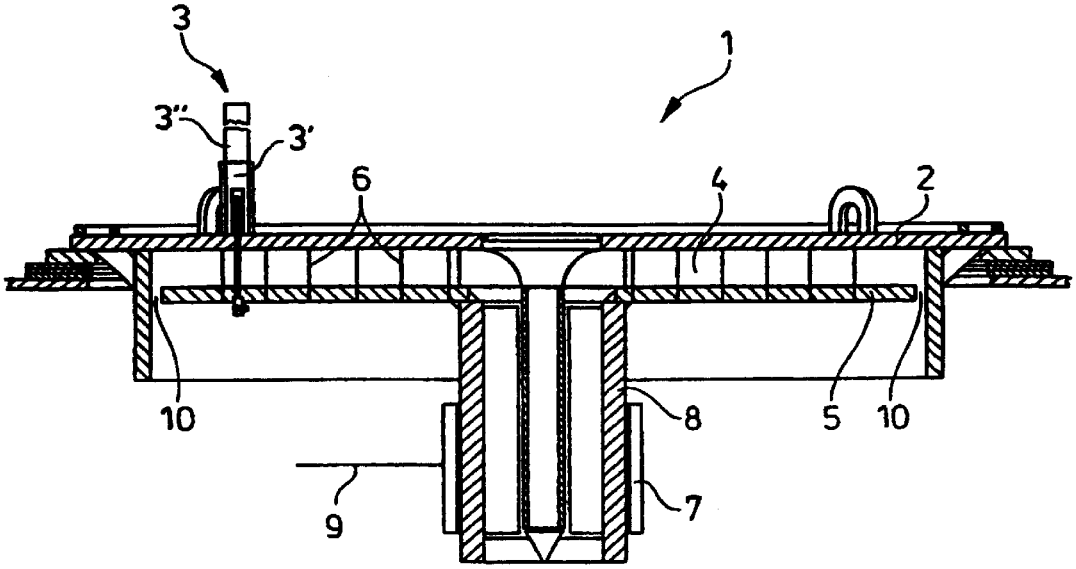
3
1
3''
3'
6
4
2
10
8
5
10
9
7

MELTING VESSELS PROVIDED WITH A COOLED BOTTOM ELECTRODE

BACKGROUND OF THE INVENTION

1. Field of the Invention

The invention relates to a bottom electrode for metallurgical melting vessels such as electric arc melting furnaces, resistance melting furnaces or ladle furnaces, comprising contact elements which ensure the electrical current supply through the refractory lining of the melting vessel into the molten mass and which are fixedly connected with their lower end to a support plate.

2. Description of the Related Art

In order to improve the service life of the contact elements that are in contact with the molten mass, it is known to cool the bottom electrode by corresponding devices arranged below the furnace vessel.

In EP 0 058 817 B1 a bottom electrode is described comprising a support plate (base plate) arranged below and at a spacing to the furnace bottom, wherein the electrode necks are directly connected to the support plate. The intermediate space between the support plate and the furnace bottom has a central air intake opening about which curved air guiding sheets are arranged in a star shape arrangement. In this way, air circulation is provided in a simple way for the purpose of cooling.

In order to adjust cooling of the bottom electrode to the operational conditions of the melting vessel, in a cooling device of a bottom electrode disclosed in EP 0 203 301 B1, in which also a support plate connecting the electrodes with one another is arranged at a spacing to the furnace bottom, the cooling air is blown in by means of two blowers via controllable valves into the hollow space between the furnace bottom and the support plate. By means of temperature sensors, arranged in bores of the contact pins (electrodes), the actual operating states (temperatures) are measured and, by means of a control and regulating device, the cooling air quantity is adjusted to these operating states by controlling the valves and switching on or off the blowers. In particular for extended operating downtimes it is achieved in this way that the rate of the temperature change of the bottom electrode does not surpass predetermined maximum values.

Disadvantages of these known bottom electrodes with a support plate for the electrodes or contact elements, which support plate is arranged at a spacing to the furnace bottom and in this way forms a cooling chamber, are:

- the bad heat dissipation from the electrode necks as a result of the bad surface area/cross-section ratio;
- the flow resistance which is caused by the electrode necks being guided through the cooling chamber;
- the bad cooling action of the refractory lining of the furnace bottom;
- a reduction of the service life as a result of feedback of the bad heat dissipation onto the contact elements;
- a considerable expenditure for renewing the contact elements as well as for its preparatory measures.

SUMMARY OF THE INVENTION

Based on this known prior art, it is an object of the invention to configure the bottom electrode constructively such that particularly by means of an improved cooling action the aforementioned disadvantages no longer occur or at least are minimized.

As a result of the measure of the invention of arranging below the support plate a cooling chamber, through which flows a preferably fluid cooling medium, and of arranging cooling ribs in this cooling chamber, which are preferably fixedly welded to the support plate, it is achieved that a larger surface area to be cooled is made available. This results in an increased heat dissipation in connection with an extended service life of the electrodes in comparison to known cooling devices according to the prior art.

According to an advantageous embodiment of the invention, the cooling ribs are additionally also connected to the cooling plate, for example, by welding, so that in addition to the improved heat dissipation there is the additional advantage of installing the current supply already on the cooling plate. In this way, the cooling ribs then provide the current supply to the support plate.

According to the invention, the contact elements are made of commercial profiled iron sections and divided into two parts comprising a thicker bottom part, whose length can be adjusted to the respective conditions of use and is preferably 200 to 400 mm, as well as a thinner top part serving as a wear part which is immersed into the molten mass and which provides the actual electric connection to the molten mass. This thin top part is welded onto the thicker bottom part. The length of the top part depends on the lining thickness and is selected such that the upper end is immersed into the molten mass and thus provides the electrical connection to the molten mass. After wear of the refractory material and the top part has occurred, the old welding seam is separated and a new top part is welded on.

As a result of the increased thickness of the bottom part of the contact element, the heat dissipation into the support plate is advantageously improved and the separation between this reinforced bottom part and the top part subjected to wear as well as its renewal are simplified.

A gaseous or a liquid medium can be employed as a cooling medium flowing through the cooling chamber. According to the invention, especially when using a liquid as a cooling medium, it is possible to use the cooling medium at the same time also for cooling the furnace vessel so that advantageously, for example, the required conveying means can be commonly used. A precondition for this is, however, that the furnace vessel is provided with a double-wall jacket.

BRIEF DESCRIPTION OF THE DRAWINGS

Further advantages, details, and features of the invention are explained in more detail in the following with the aid of an embodiment illustrated schematically in the drawing.

The FIGURE shows a bottom electrode 1 with a cooling chamber 4 according to the invention.

DETAILED DESCRIPTION OF THE PREFERRED EMBODIMENTS

On the support plate 2 of the bottom electrode 1 contact elements 3 with their bottom parts 3' are connected by welding (only one contact element 3 is illustrated) and onto it the thinner top part 3" is fastened, wherein the attachment is preferably also carried out by welding.

Below the support plate 2 a cooling plate 5 is arranged at a spacing so that between the support plate 2 and the cooling plate 5 the cooling chamber 4 is formed through which a preferably fluid cooling medium can flow. For an improved cooling action cooling ribs 6 are welded onto the support plate 2 by which the cooling surface area is significantly increased and the cooling action is correspondingly enhanced. In order to improve these advantages even further, the cooling ribs 6 are also fixedly connected with the cooling plate 5 so that an additional cooling effect is achieved. Accordingly, since a direct metallic contact between the cooling plate 5 and the support plate 2 is provided, this contact can be used also for current supply.

In the illustrated embodiment, the current is supplied via a current supply line 9 via a contact jaw 7 of the bottom electrode 1 arranged on pipe 8. In this way, the current flows from the contact jaw 7 via the pipe 8 to the cooling plate 5, from here via the cooling ribs 6 to the support plate 2, from where the contact elements 3 realize the current flow to the molten mass.

The cooling medium can be supplied centrally from below through the pipe 8 into the cooling chamber 4 and then removed via lateral openings 10. However, it is also possible to use the lateral openings 10 for supplying and removing the cooling medium. Depending on the configuration of the supply and removal points for the cooling medium and the thus resulting flow conditions, the cooling ribs 6 are correspondingly shaped and aligned in order to obtain a cooling action as large as possible for a flow resistance as minimal as possible.

The invention is not limited to the illustrated embodiment but is also suitable for other embodiments of bottom electrodes in as much as the constructive possibility of providing a cooling chamber by arranging a cooling plate is present.

What is claimed is:

1. A bottom electrode for metallurgical melting vessels having a refractory lining containing a molten mass, the bottom electrode comprising contact elements for effecting an electrical current supply through the refractory lining of the melting vessels into the molten mass, the contact elements having lower ends connected to a support plate, a cooling plate mounted at a spacing below the support plate, such that a cooling chamber for conducting cooling medium therethrough is formed between the support plate and the cooling plate, wherein each of the contact elements is comprised of a bottom part and a top part of profiled iron sections, wherein the bottom part is thicker than the top part, and wherein the bottom part is welded onto the top part.

2. The bottom electrode according to claim 1, further comprising cooling ribs attached to the support plate, wherein the cooling ribs project into the cooling chamber.

3. The bottom electrode according to claim 2, wherein the cooling ribs are additionally attached to the cooling plate, whereby, when a current supply is provided on the cooling plate, an electrical contact is effected between the cooling plate and the support plate.

4. The bottom electrode according to claim 1, wherein the bottom part has a length of 200–400 mm, the bottom part has a wall thickness of between 6 and 10 mm, and the top part has a wall thickness of between 2 and 5 mm.

5. The bottom electrode according to claim 4, wherein the cooling medium is simultaneously used for cooling the melting vessel.

* * * * *